United States Patent [19]

Katterhenry et al.

[11] Patent Number: 4,932,224

[45] Date of Patent: Jun. 12, 1990

[54] ADJUSTABLE BASE COVER FOR REFRIGERATOR

[75] Inventors: Glenn E. Katterhenry, Evansville; John C. Slingerland, Wadesville, both of Ind.

[73] Assignee: Whirlpool Corporation, Benton Harbor, Mich.

[21] Appl. No.: 346,645

[22] Filed: May 3, 1989

[51] Int. Cl.[5] ..... F25D 11/00

[52] U.S. Cl. ..... 62/440; 62/441; 62/455; 312/236

[58] Field of Search ..... 62/440, 441, 282, 454, 62/455, 302; 312/236, 214; 98/114; 220/367

[56] References Cited

U.S. PATENT DOCUMENTS

| | | | |
|---|---|---|---|
| 2,673,455 | 3/1954 | Brinkoeter | 62/455 X |
| 2,811,840 | 11/1957 | Thompson | 62/455 X |
| 3,079,770 | 3/1963 | Brown et al. | 62/455 |
| 3,157,306 | 11/1964 | Courson | 62/277 X |
| 3,232,071 | 2/1966 | Wallenbrock et al. | 62/441 X |
| 3,912,349 | 10/1975 | Hoetker | 312/214 X |

*Primary Examiner*—Lloyd L. King
*Attorney, Agent, or Firm*—Wood, Phillips, Mason, Recktenwald & VanSanten

[57] ABSTRACT

A base cover is disclosed which can be set to any height between the minimum and maximum heights created when a refrigerator cabinet is adjusted into its final position at an installation site. The base cover is made of three piece overlapping construction. Particularly, a top piece comprises an elongated plate which is securable to a refrigerator cabinet base assembly. A front piece is provided with a plurality of vent openings and screw slots for adjustably fastening the front piece to the top piece. Particularly, the front piece overlaps at least part of the top piece and the vertical height adjustment is provided by varying the overlap by adjusting the position of fastening scews in the screw slots. The front piece includes additional screw slots through which screws may be inserted and fastened to a bottom piece for varying the overlap therebetween to provide further height adjustment.

18 Claims, 4 Drawing Sheets

FIG. 12
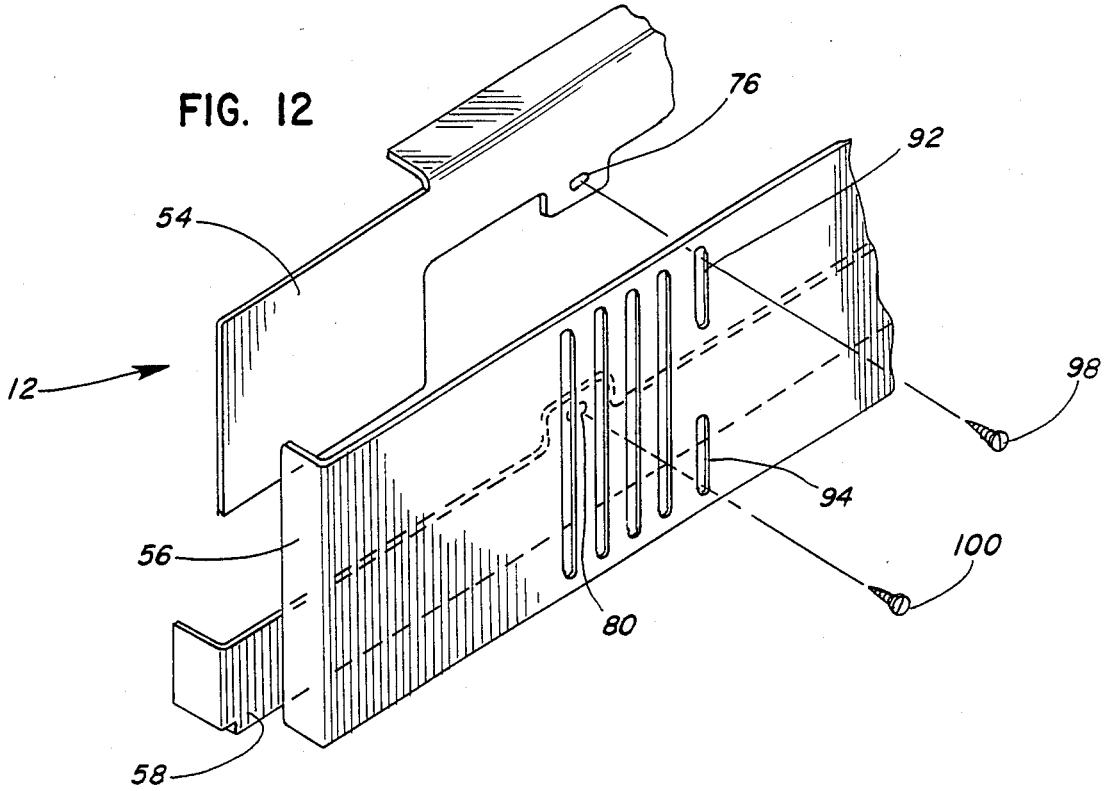
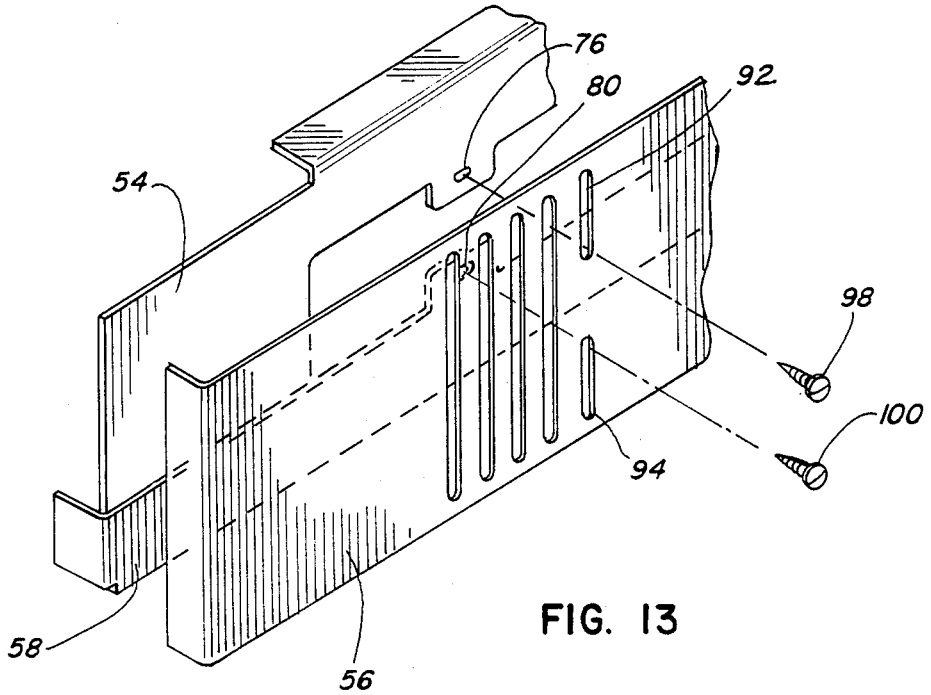
FIG. 13

ADJUSTABLE BASE COVER FOR REFRIGERATOR

BACKGROUND OF THE INVENTION

1. Field of the Invention

This invention relates generally to refrigerator cabinets and, more particularly, to an adjustable base cover therefor.

2. Description of Background Art

A refrigeration apparatus, such as a refrigerator/-freezer, conventionally includes a cabinet having a storage compartment and a door for the compartment. Refrigerators are intended to be free standing and to rest on a floor or other flat surface. Specifically, the cabinet has a base support assembly which provides a compartment below the storage compartment for housing various machine components. Adjustable leveling legs are typically fastened to the base assembly for adjusting the vertical spacing of the cabinet from the floor to compensate for an uneven or non-level floor.

The need for adjusting the floor to cabinet spacing is of particular importance when the cabinet comprises a built-in refrigerator cabinet. With such a built-in refrigerator cabinet, the unit is typically flush mounted with adjacent cabinets and must suitably fill in the space provided therefor. To do so, it may be necessary to adjust the height of the top of the cabinet so that it is spaced a desirable distance from superjacent cabinets or other structure. Such adjustment is accomplished by suitably adjusting all of the leveling legs an equal amount, assuming the cabinet is otherwise level.

Thus, the amount of adjustment required of each leveling leg depends on variations found in kitchen construction, such as the level of the floor on which it is resting, and also desired alignment with adjacent cabinets, including alignment with adjacent cabinet toe space. Such varying conditions cause the space between the floor and the bottom of the door to vary from one installation to another.

Most refrigerator cabinets include a base grill or cover to cover the space between the door and the floor and to restrict access to the machine compartment. One example of such a base grill is shown in Hoetker U.S. Pat. No. 3,912,349. Such a conventional base cover is normally sized to the minimum height which can be expected between the floor and the bottom of the door. However, when the height of the cabinet is adjusted to its maximum, the base cover cannot fully cover the opening into the machine compartment, or an undesirably large gap results between the lowermost portion of the base cover, or the cabinet frame, and the floor.

The present invention is intended to overcome one or more of the problems as set forth above, in a novel and simple manner.

SUMMARY OF THE INVENTION

In accordance with one aspect of the invention, a refrigeration apparatus is provided with an adjustable height base cover.

Broadly, there is disclosed herein an improvement in a refrigeration apparatus which includes a cabinet having a storage compartment and a door for the compartment. A base assembly defining a machine compartment below the storage compartment has a front access opening below the door. Adjustable leveling legs are fastened to the base assembly for adjusting the vertical spacing of the cabinet and thus the door from a support surface. The improvement comprises a base cover fastenable to the base assembly for covering the access opening below the door and including means for adjusting the height of the base cover to substantially fill the vertical spacing between the door and the support surface.

It is a feature of the invention that the base cover comprises a multipiece base cover assembly.

It is another feature of the invention that the base cover is of two piece overlapping construction and the adjusting means comprises means for varying the overlap of the two pieces.

It is a further feature of the invention that the base cover includes vent openings to provide ventilation of the machine compartment.

It is still a further feature of the invention that the base cover comprises a top piece fastenable to the base assembly, and a front piece partially overlapping the top piece. Further, a bottom piece may also be provided which partially overlaps the front piece. In one embodiment, the front piece includes vent openings to provide ventilation of the machine compartment.

In the illustrative embodiment, a base cover is disclosed which can be set to any height between the minimum and maximum heights created when the refrigerator cabinet is adjusted into its final position at the installation site. The base cover is made of two piece overlapping construction. Particularly, a top piece comprises an elongated plate which is securable to the refrigerator cabinet base assembly. A front piece is provided with a plurality of vent openings and screw slots for adjustably fastening the front piece to the top piece. Particularly, the front piece overlaps at least part of the top piece and the vertical height adjustment is provided by varying the overlap by adjusting the position of fastening screws in the screw slots.

If adequate adjustment cannot be achieved with two pieces, then a bottom extension piece is provided. Specifically, the front piece includes additional screw slots through which screws may be inserted and fastened to the bottom piece for varying the overlap therebetween to provide further height adjustment.

Further features and advantages of the invention will readily be apparent from the specification and from the drawings.

BRIEF DESCRIPTION OF THE DRAWINGS

FIG. 12 is a generalized, perspective, exploded view illustrating the base cover assembly adjusted to the maximum height; and FIG. 13 is a generalized, perspective, exploded view illustrating the base cover assembly adjusted to the minimum height.

DETAILED DESCRIPTION OF THE INVENTION

Figure 1:
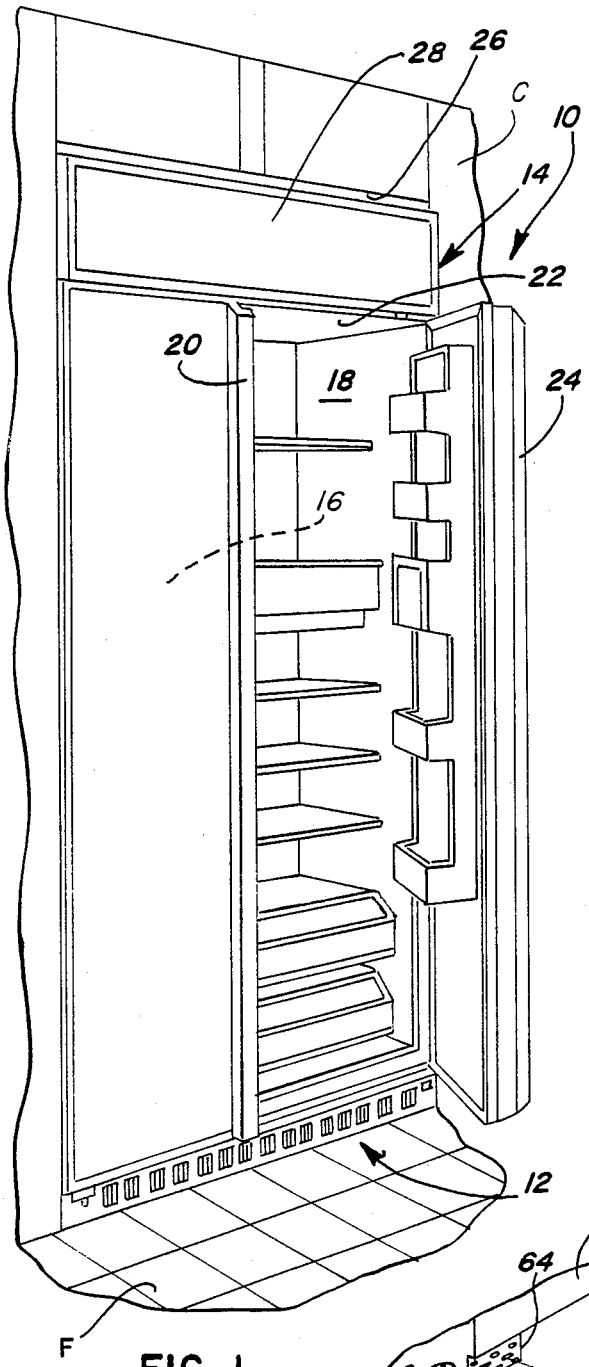
FIG. 1 is a perspective view of a built-in refrigerator having an adjustable base cover embodying the invention.

Referring to FIG. 1, a refrigeration apparatus, such as a refrigerator/freezer 10, includes an adjustable base cover assembly 12 according to the invention. The invention is shown utilized with a built-in, side-by-side refrigerator/freezer; however, other types of refrigeration apparatus may be used in conjunction with the adjustable base cover assembly of the present invention, as will be obvious to those skilled in the art.

The refrigerator/freezer 10 includes a cabinet 14 housing a below-freezing, or freezer, compartment 16 and a fresh food, or above-freezing, compartment 18. The freezer compartment 16 is accessible through an access opening (not shown). A freezer door 20 is provided for selectively closing the freezer access opening. Similarly, the fresh food compartment 18 includes an access opening 22 and a fresh food door 24 is provided for selectively closing the fresh food access opening 22.

As specifically illustrated in FIG. 1, the refrigerator/-freezer 10 is adapted to b®mounted flush and immediately adjacent to cabinets C. The cabinets C are installed to provide a rectangular opening 26 for receiving the cabinet 14. A decorative grill assembly 28 is fastened to the top of the cabinet 14.

Figure 2:
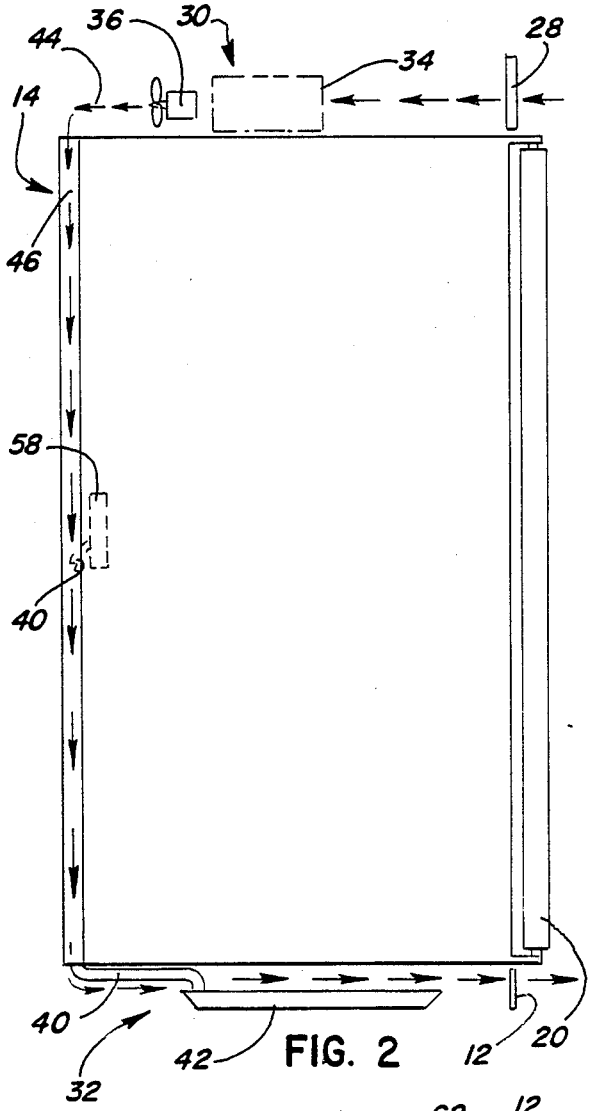
FIG. 2 is a side view of the refrigerator of FIG. 1, with parts removed for clarity, schematically illustrating the flow of machinery compartment cooling air.

Referring also to FIG. 2, a top machine compartment 30 is provided at the top of the cabinet 14, while a lower machine compartment 32 is provided below the cabinet 14. Conventional refrigeration components, such as a compressor 34 and condenser (not shown), are top mounted in the upper machine compartment 30. A cooling fan 36 is provided for drawing cooling air past the condenser 34 and compressor. Thus, the grill 28 serves to cover and fill in the space between the top of the cabinet 14 and adjacent cabinets C and to provide ventilation for the top mounted refrigeration components.

A conventional evaporator 38 is mounted within the cabinet 14. During a conventional defrost cycle, defrost water from the evaporator flows through a tube 40 down to a large-area shallow evaporator pan 42 mounted in the lower machine compartment 32. The air from the cooling fan 36, illustrated by the arrows 44, is heated due to the heat generated by the compressor 34. A portion of the heated air travels down through a duct 46 on the rear of the cabinet 12 and down into the lower machine compartment 32 where it passes over the evaporator pan 42 and out through the front of the adjustable base cove 12.

Figure 3:
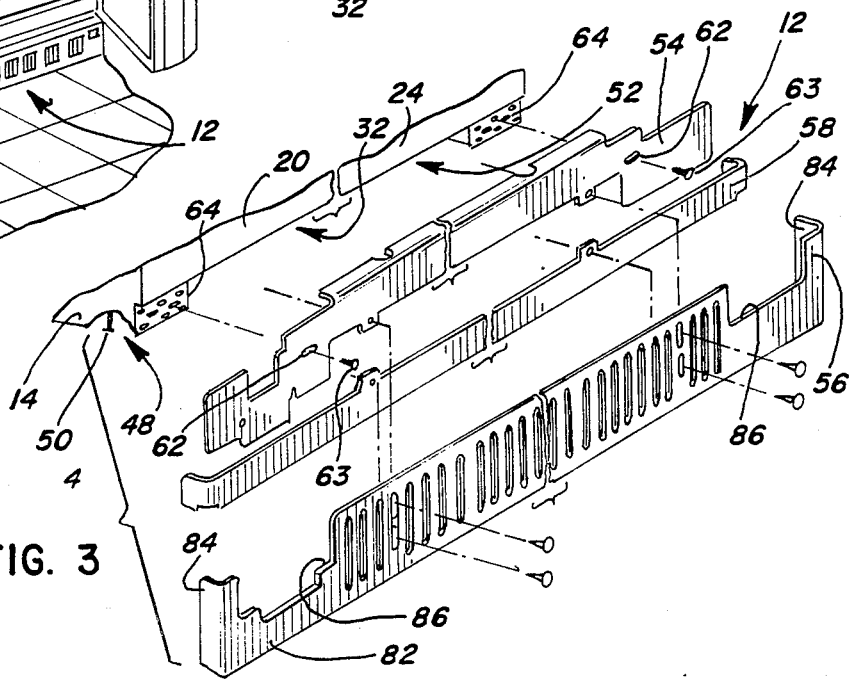
FIG. 3 is a partially cut-away, exploded view of the bottom portion of the refrigerator cabinet of FIG. 1, with certain parts removed for clarity, specifically illustrating the installation of the adjustable base cover.

Referring to FIG. 3, the cabinet includes a base assembly, indicated generally at 48, at the underside of the cabinet 14. The base assembly 48 supports the cabinet 14, defines the perimeter of the lower machine compartment 32 and provides an access opening 52 into the lower machine compartment 32. An adjustable leveling leg 50 is adjustably fastened to the base assembly 48 at each corner. Leveling or height adjustment of the cabinet 14 is provided by suitably turning each leveling leg 50 in any known manner to adjust the spacing of the cabinet 14 from the floor. Specifically, according to the amount of adjustment of each leveling leg 50, the spacing between the bottom of the doors 20 and 24 and the floor F is varied, thereby providing a variable sized access opening 52. The adjustable base cover assembly 12 according to the invention is provided with means for adjusting the height of the base cover assembly 12 to suitably fill in the variable space provided for the lower machine compartment access opening 52.

As illustrated, the base cover assembly 12 includes a base cover top piece 54, a base cover front piece 56, and a base cover bottom piece 58.

Figure 4:
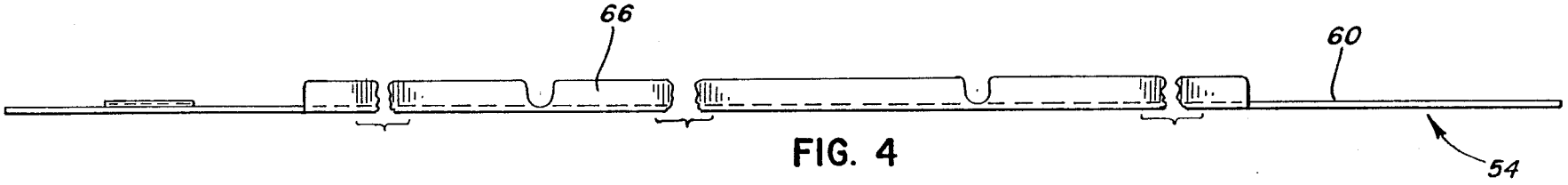
FIG. 4 is a plan view of a base cover top piece for the base cover of FIG. 3.
Figure 5:
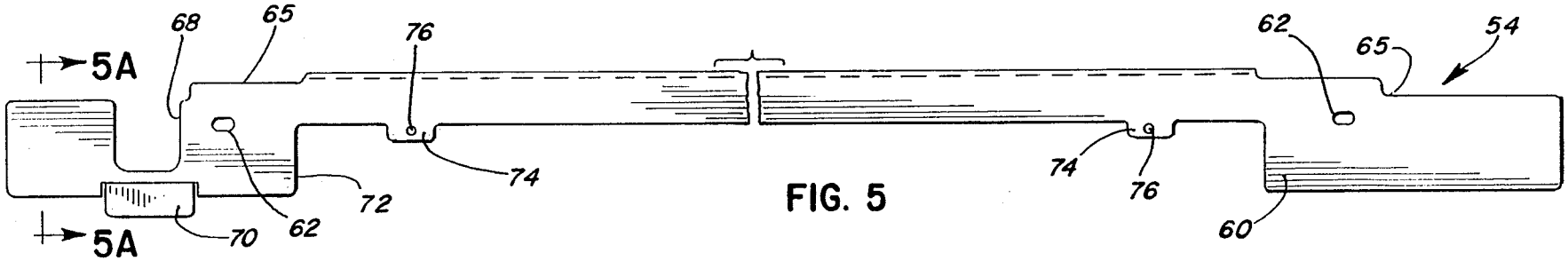
FIG. 5 is an elevational view of the top piece of FIG. 4.
Figure 5A:
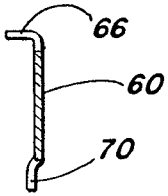
FIG. 5*a* is a sectional view taken along the lines 5*a*—5*a* of FIG. 5.

Referring to FIGS. 4, 5 and 5*a*, the base cover top piece comprises an elongated generally rectangular plate 60. The plate 60 includes an aperture 62 adjacent each end through which a suitable fastener, such as a screw 63, see FIG. 3, can be inserted for securing the top piece 54 to base assembly mounting brackets 64. Thus, the top piece 54 is fastened to the cabinet in a fixed position immediately below the doors 20 and 24. A notch portion 65 is provided at the opposite ends of the plate 60 to provide clearance for mounting of door hinges (not shown) to the brackets 64. Between the notch portions 65, an inwardly turned flange 66 is provided. This flange 66 extends under the cabinet 14 between the brackets 65. A further generally rectangular notch cutout 68 is provided at the leftmost end and is adapted to provide clearance for a crossover tube which is pivotally mounted to the freezer door 20 and extends into the lower machine compartment 32. Immediately below the opening 68 is an inwardly turned tab 70.

Below the flange 66, a generally rectangular elongated notch cutout 72 is provided between the fastening apertures 62. Extending into the cutout 72 are tabs 74, each including a threaded opening 76. The notch cutout 72 is adapted to operate in conjunction with the front piece 56 to provide for the passage of cooling air 44.

Figure 7:
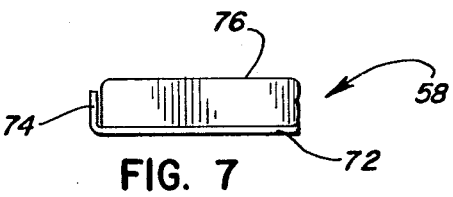
FIG. 7 is a partial plan view of the bottom extension piece of FIG. 6.
Figure 6:
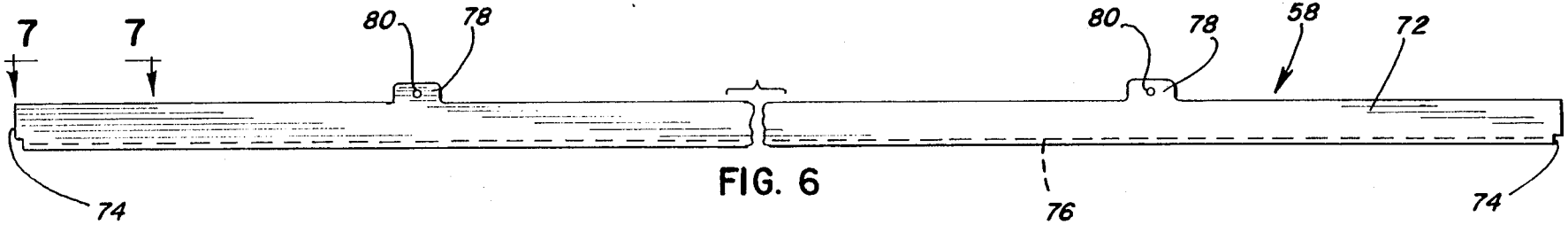
FIG. 6 is an elevational view of a base cover bottom extension piece for the base cover of FIG. 3.

Referring to FIGS. 6 and 7, the bottom piece 58 comprises an elongated metal plate having a front wall 72 connected to inwardly turned ends 74 and a rearwardly turned bottom flange 76. A pair of tabs 78 each including a threaded opening 80 extend upwardly from the front wall 72. The spacing between the tabs 78 and openings 80 is similar to that between the tabs 74 and openings 76 of the top piece, see FIG. 5.

Figure 9:
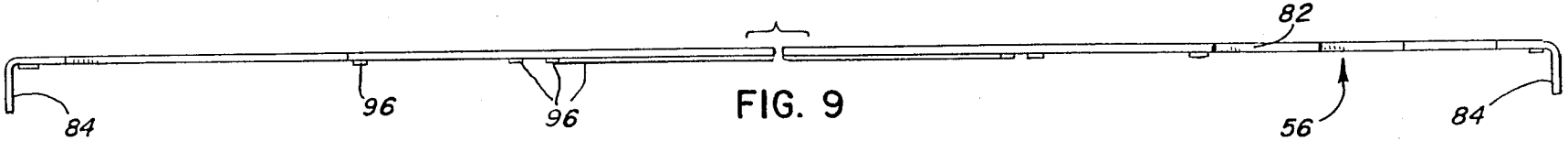
FIG. 9 is a plan view of the front piece of FIG. 8.
Figure 8:
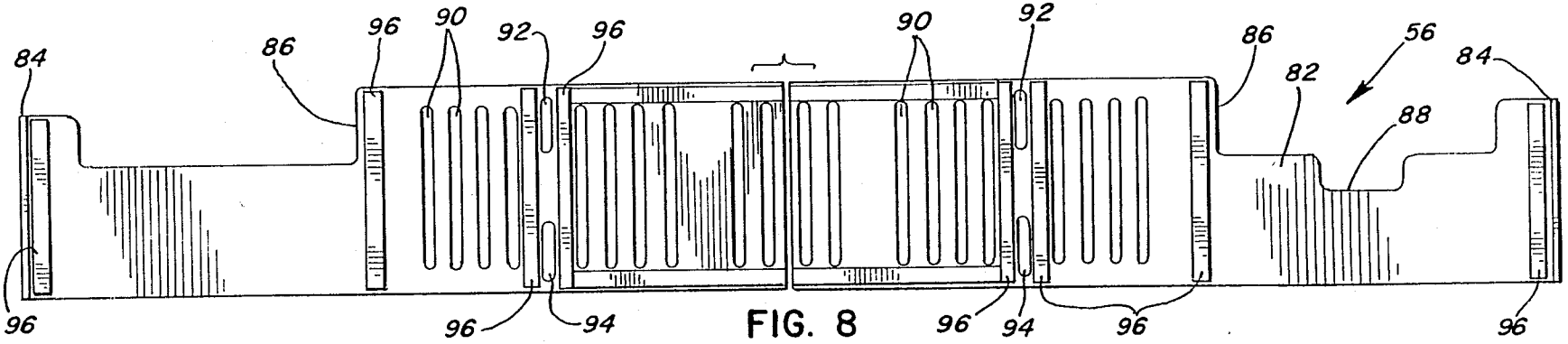
FIG. 8 is an elevational view of a base cover front piece for the base grill of FIG. 3.

Referring now to FIGS. 8 and 9, the front piece 56 comprises an elongated metal plate 82 having rearwardly turned opposite ends 84. A generally rectangular notch 86 is provided at each upper end of the plate 82 . A further rectangular notch portion 88 is provided at one end, corresponding to the top piece notch portion 68, for allowing clearance for a crossover tube.

In the area between the notches 86, the plate 82 includes a plurality of transverse elongated vent slots 90 for permitting flow of cooling air 44, see FIG. 2, therethrough. The number and size of the slots is dependent upon the amount of air required to pass through the base cover assembly 12, as will be obvious to those skilled in the art.

The plate 82 also includes two shorter laterally extending longitudinally spaced slots 92 and two bottom laterally extending longitudinally spaced slots 94. The longitudinal spacing between the slots 92 and the slots 94 corresponds to the spacing between the respective apertures 76 of the top piece 54, see FIG. 5, and the spacing of the apertures 80 of the bottom piece 58, see FIG. 6. A plurality of foam pads 96 are adhered to the rear of the plate 82 to provide sound dampening owing to the interconnection among the base cover pieces 54, 56, and 58, as discussed below.

Figure 10:
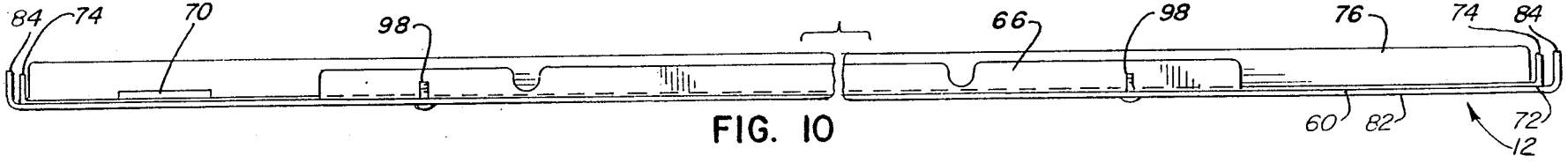
FIG. 10 is a plan view of the fully assembled base cover of FIG. 3.
Figure 11:
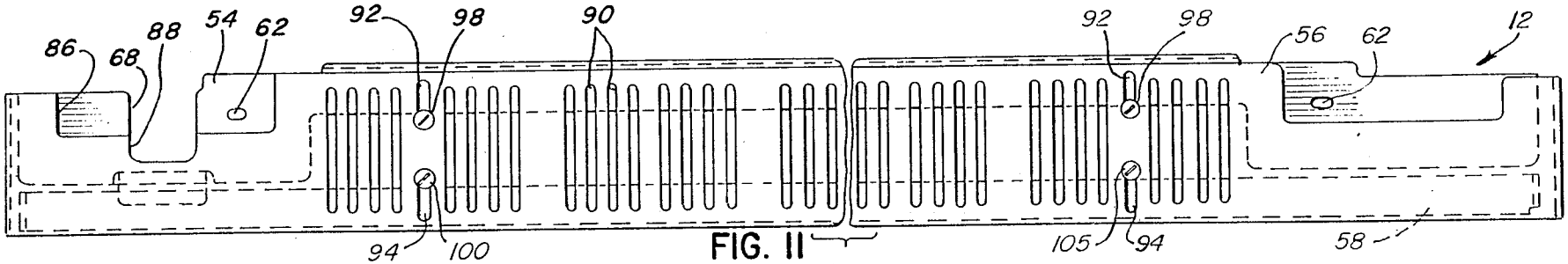
FIG. 11 is an elevational view of the fully assembled base cover of FIG. 3.

Referring to FIGS. 10 and 11, the base cover 12 is assembled by placing the front piece 56 forwardly of the top piece 54 and partially overlapping the same. Specifically, the front piece top slots 92 are aligned with the top piece threaded opening 76, and fasteners, such as screws 98 are inserted through the slots 92 and into the openings 76. Similarly, the bottom piece 58 is positioned behind the front piece 56 in overlapping relation, with the front piece bottom slots 94 aligned with the bottom piece threaded openings 80. Fastening elements, such as screws 100, are inserted through the slots 94 into the threaded openings 80.

The base cover assembly 12 is fastened to the cabinet 14, as discussed above and shown in FIG. 3.

When so installed, the height of the base cover assembly 12 can be adjusted by loosening either both screws 98 and adjusting the overlap between the front piece 56 and the top piece 54, or by loosening the screws 100 and adjusting the overlapping between the front piece 56 and the bottom piece 58.

FIG. 12 illustrates the pieces adjusted to provide the maximum height of the base cover assembly 12. More specifically, the top and bottom piece apertures 76 and 80 are aligned with the outermost portions of the respective front piece slots 92 and 94 when the respective fasteners 98 and 100 are tightened. Conversely, minimal height of the cover assembly 12 is provided by positioning the respective slots 76 and 80 proximate the innermost portion of the respective slots 92 and 94 when the respective fasteners 98 and 100 are tightened, as is illustrated in FIG. 13.

Any height between the minimum and maximums illustrated in FIGS. 12 and 13 are provided by adjusting the overlapping as necessary or desired. As will be appreciated, the base cover assembly 12 may be provided or used as a two piece assembly comprising the top piece 54 and the front piece 56 if only minimal height adjustment is necessary. If additional height adjustment is necessary, then the bottom piece 58 is also used.

The sound dampening pads 96, shown specifically in FIG. 8, provide a cushion between the front piece 56 and the top and bottom pieces 54 and 58 to dampen vibration therebetween which might cause an undesirable noise caused by cabinet vibrations.

Thus, the invention comprehends a base cover including overlapping pieces which may be infinitely adjusted between minimum and maximum heights.

We claim:

1. In a refrigeration apparatus including a cabinet having a storage compartment and a door for said compartment, a base assembly defining a machine compartment below said storage compartment having a front access opening below said door, and adjustable leveling legs fastened to said base assembly for adjusting the vertical spacing of said cabinet and thus said door from a support surface, the improvement comprising:

a base cover fastenable to said base assembly for covering said access opening below said door an including means for adjusting the height of said base cover to substantially fill the vertical spacing between said door and the support surface.

2. The improvement of claim 1 wherein said base cover comprises a multiple piece base cover assembly.

3. The improvement of claim 1 wherein said base cover is of two piece overlapping construction and said adjusting means comprises means for varying the overlap of said two pieces.

4. The improvement of claim 1 wherein said base cover includes vent openings to provide ventilation of said machine compartment.

5. The improvement of claim 1 wherein said base cover comprises a three piece base cover having a top piece fastenable to said base assembly, a front piece partially overlapping said top piece and a bottom piece partially overlapping said front piece.

6. The improvement of claim 5 wherein said front piece includes vent openings to provide ventilation of said machine compartment.

7. The improvement of claim 1 wherein said base cover height is infinitely adjustable between minimum and maximum heights.

8. A refrigeration apparatus comprising:

a cabinet having a storage compartment defining a storage compartment front access opening and a base assembly defining a machine compartment below said storage compartment having a machine compartment front access opening below said storage compartment front access opening;

a door hingedly mounted to said cabinet for selectively closing said storage compartment access opening;

a plurality of adjustable leveling legs fastened to said base assembly for adjusting the vertical spacing of said door from a support surface for the cabinet; and an adjustable height base cover fastenable to said base assembly for covering said machine compartment front access opening to substantially fill the vertical spacing between said door and the support surface.

9. The refrigeration apparatus of claim 8 wherein said base cover is of two piece overlapping construction including means for varying the overlap of said two pieces.

10. The refrigeration apparatus of claim 9 wherein said base cover comprises a top piece fastenable to said base assembly and a front piece partially overlapping said top piece.

11. The refrigeration apparatus of claim 10 wherein said base cover further comprises a bottom piece partially overlapping said front piece.

12. The refrigeration apparatus of claim 11 wherein said front piece includes vent openings to provide ventilation of said machine compartment.

13. The refrigeration apparatus of claim 8 wherein base cover height is infinitely adjustable between minimum and maximum heights.

14. A built-in refrigeration apparatus comprising:

a cabinet having a storage compartment defining a storage compartment front access opening, an upper machine compartment housing refrigeration components, a base assembly defining a lower machine compartment below said storage compartment having a machine compartment front access opening below said storage compartment front access opening;

a door hingedly mounted to said cabinet for selectively closing said storage compartment access opening;

means for conducting machine cooling air from said upper machine compartment to said lower machine compartment;

a plurality of adjustable leveling legs fastened to said base assembly for adjusting the vertical spacing of said door from a support surface for the cabinet; and an adjustable height vent base cover fastenable to said base assembly for covering said machine compartment front access opening to substantially fill the vertical spacing between said door and the support surface and provide for passage of cooling air thereby.

15. The built-in refrigeration apparatus of claim 14 wherein said base cover is of two piece overlapping construction including means for varying the overlap of said two pieces.

16. The built-in refrigeration apparatus of claim 14 wherein said base cover comprises a top piece fastenable to said base assembly and a front piece partially overlapping said top piece.

17. The built-in refrigeration apparatus of claim 16 wherein said base cover further comprises a bottom piece partially overlapping said front piece.

18. The built-in refrigeration apparatus of claim wherein said front piece includes vent openings to provide ventilation of said machine compartment.

* * * * *